US007637190B2

(12) United States Patent
Granger

(10) Patent No.: US 7,637,190 B2
(45) Date of Patent: Dec. 29, 2009

(54) WIPING MATERIAL DISPENSER PROVIDED WITH A CUTTING DEVICE COMPRISING A FORMAT SELECTING UNIT

(76) Inventor: Maurice Granger, 17 Rue Marcel Pagnol, Saint Priest en Jarez (FR) 42270

( * ) Notice: Subject to any disclaimer, the term of this patent is extended or adjusted under 35 U.S.C. 154(b) by 670 days.

(21) Appl. No.: 11/568,126

(22) PCT Filed: Apr. 13, 2005

(86) PCT No.: PCT/FR2005/050233

§ 371 (c)(1),
(2), (4) Date: Oct. 20, 2006

(87) PCT Pub. No.: WO2005/112725

PCT Pub. Date: Dec. 1, 2005

(65) Prior Publication Data

US 2007/0215743 A1 Sep. 20, 2007

(30) Foreign Application Priority Data

Apr. 30, 2004 (FR) ..... 04 04857

(51) Int. Cl.
*B26D 7/00* (2006.01)
*B65H 18/14* (2006.01)
*B23D 25/06* (2006.01)

(52) U.S. Cl. ..... 83/337; 242/564.1; 242/649

(58) Field of Classification Search ..... 83/648–650, 83/337; 225/6, 10; 242/560, 560.1, 564.4, 242/564.1

See application file for complete search history.

(56) References Cited

U.S. PATENT DOCUMENTS

| | | | | |
|---|---|---|---|---|
| 3,896,691 | A * | 7/1975 | Granger et al. | 83/335 |
| 3,998,120 | A * | 12/1976 | Granger et al. | 83/335 |
| 6,363,824 | B1 * | 4/2002 | Granger | 83/334 |
| 6,446,901 | B1 * | 9/2002 | Haen et al. | 242/564.1 |
| 6,457,394 | B1 * | 10/2002 | Granger | 83/649 |
| 6,474,209 | B1 * | 11/2002 | Granger | 83/649 |
| 6,474,591 | B1 * | 11/2002 | Granger | 242/560 |
| 6,497,167 | B1 | 12/2002 | Granger | |
| 6,895,848 | B1 * | 5/2005 | Svensson | 83/649 |
| 6,997,094 | B2 * | 2/2006 | Granger | 83/649 |
| 7,338,007 | B2 * | 3/2008 | Valot | 242/559 |

(Continued)

FOREIGN PATENT DOCUMENTS

FR 2 828 084 2/2003

*Primary Examiner*—Kenneth E. Peterson
*Assistant Examiner*—Sean Michalski
(74) *Attorney, Agent, or Firm*—Heslin Rothenberg Farley & Mesiti P.C.

(57) ABSTRACT

A wiping material dispenser includes a drum receiving a cutting blade holder. An extension of one of the drum lateral sides comprises an offset supporting plate provided with an opening for fixing an end of the blade holder. A toothed sector is mounted on the end and interacts with a gearwheel freely mounted on the drum axis and connected to a hooked cam. The drum has a projected element having a ramp profile. A lateral flange of a housing receiving the drum axis makes it possible to fix a shaped body exhibiting elastic pivoting capacity in order for an end thereof to interact with the hooked cam or the projected element.

9 Claims, 6 Drawing Sheets

U.S. PATENT DOCUMENTS

| | | | | |
|---|---|---|---|---|
| 7,571,670 | B2 * | 8/2009 | Formon | 83/648 |
| 2002/0152870 | A1 * | 10/2002 | Granger | 83/649 |
| 2002/0152871 | A1 * | 10/2002 | Granger | 83/649 |
| 2003/0116003 | A1 * | 6/2003 | Kapiloff | 83/649 |
| 2003/0140753 | A1 * | 7/2003 | Granger | 83/335 |
| 2004/0188486 | A1 * | 9/2004 | Granger | 225/93 |
| 2006/0065094 | A1 * | 3/2006 | Lewis et al. | 83/649 |
| 2006/0236836 | A1 * | 10/2006 | Cassia | 83/649 |
| 2007/0010389 | A1 * | 1/2007 | Cutrona et al. | 493/446 |
| 2007/0137454 | A1 * | 6/2007 | DesRosiers et al. | 83/614 |
| 2007/0221777 | A1 * | 9/2007 | Valot | 242/560 |
| 2007/0234868 | A1 * | 10/2007 | Formon et al. | 83/649 |

* cited by examiner

WIPING MATERIAL DISPENSER PROVIDED WITH A CUTTING DEVICE COMPRISING A FORMAT SELECTING UNIT

CROSS REFERENCE TO RELATED APPLICATIONS

This is a Section 371 filing of international application No. PCT/FR2005/050233, filed on Apr. 13, 2005, and published, in French, as International Publication No. WO 2005/112725 A1 on Dec. 1, 2005, and claims priority of French Application No. 0404857 filed on Apr. 30, 2004, which applications are hereby incorporated by reference, in their entirety.

BACKGROUND ART

The invention relates to the technical sector of automatic-cut appliances for the dispensing of wiping materials of the tissue-paper type for hand-wiping, toilet-paper and general wiping and cleaning applications.

The Applicant has developed many appliances of this type which conventionally comprise a housing, a cover and a drum with an incorporated cutting blade, the said blade being capable of emerging from the drum during operation by virtue of means for the triggering and return of the drum. Lateral flanges of the housing are arranged so as to support the material reel which comes to bear either directly on the drum, according to the teaching of the Patent FR 2,322,215, or in a plane above the drum, without contact with the latter, as, for example, in the embodiment described in the Patent FR 2,799,946. In this specific implementation, a pressing roller is capable of ensuring pressure on the material strip at a given location, in addition to a second pressure zone defined towards the cutting zone of the material strip in the region of the drum. Thus, the loading reel may be mounted either so as to bear on the drum receiving the cutting mechanism or in a plane above the drum and without contact with the latter. These various types of appliances, in their basic concept and with various arrangements, are widely sold by the applicant worldwide through his licenses.

The Applicant therefore developed another automatic-cut appliance for the dispensing of wiping material, which is simplified in its implementation and is the subject of the Patent FR 2,828,084. In brief, the appliance comprises a basic housing with a bottom face and a lower face, having a cover, the said housing receiving, removably by snap connection, a cartridge defining a carrier structure comprising two transverse lateral flanges, a connecting plate arranged between the flanges and a front spacer block. The flanges, in their upper part, receive connectors for supporting the material reel and, in their lower part, receive two drums arranged side by side, without direct contact between them, the first drum being the blade-carrying drum, the second being the guide drum, and the said drums being arranged, at one of their ends facing one another, so as to receive toothed rings allowing their connection and their rotation relative to one another. The blade-carrying drum is arranged, moreover, with a third toothed ring cooperating with the mechanism for triggering the rotation of the drums, including a fixed cam. This blade-carrying arm of the cutting device includes a movable blade which cooperates with the abovementioned fixed cam, at the same time defining the path of the cutting blade. This specific appliance includes a gauge for ensuring the setting of the format of the material strip to be dispensed, either by means of a prior change of pinion or with the use of a sliding pinion displaceable so as to cooperate, depending on position, with such and such a gearwheel, in particular by means of an arrangement of the drum.

The said sliding pinion is associated with a projecting index finger mounted on the movable shaft supporting the sliding pinion and so as to be displaced beforehand by the operator. This requires a prior setting of the format by the operator, with the appliance being opened.

In all the embodiments developed hitherto by the Applicant, the cutting device is independent of the arrangements and mechanisms allowing format selection.

Within the framework of his personal research, the Applicant wanted to improve the emergence of the cutting blade from the drum, with a smooth operation, this being adaptable to any type of dispensing appliance recalled above.

Another object sought after according to the invention was to incorporate an additional format selector device into the said cutting device, the said format selector device having a simplified construction, with a minimum number of parts, and being easier for the operator to set.

The object sought after by the Applicant was therefore to afford improvements to the cutting device and to the format selection device which can be incorporated in an optimized manner into existing appliances.

These objects and yet others may be gathered from the rest of the description.

SUMMARY OF THE INVENTION

According to a first characteristic of the invention, the appliance for the dispensing of wiping materials, of the type comprising a housing with lateral flanges, between which are arranged a drum receiving a blade carrier with a cutting blade, and a material reel, is notable in that one of the transverse sides of the drum has, in its prolongation, an offset supporting plate possessing an orifice for fastening the end of the blade carrier, in that a toothed quadrant is mounted on the said end, with a toothed peripheral end, in that the toothed quadrant cooperates with a gearwheel mounted freely on the shaft of the drum, the said gearwheel being secured to a hooked cam, and in that the drum possesses, on the outer face of the said transverse side, a projecting shape with a ramp profile, and in that the lateral flange of the facing housing receiving the shaft of the drum allows the fastening of a profiled body arranged between two fixed stops, the said body having an elastic pivoting capability so as to cooperate, by means of its end forming an appendage and head, either with the said hooked cam or with the said projecting shape, according to the operation and pulling of the material strip.

BRIEF DESCRIPTION OF THE DRAWING FIGURES

To clarify the subject of the invention, the latter is illustrated in a non-limiting way in the figures of the drawings where:

DETAIL DESCRIPTION

Figure 1:
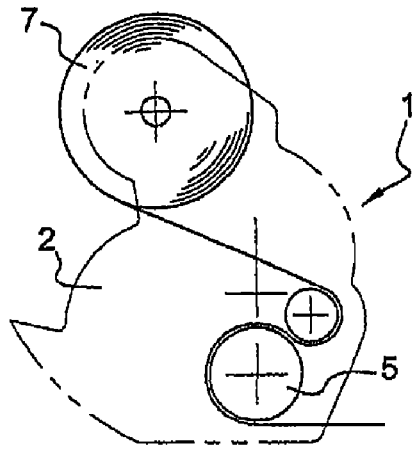
FIG. 1 is a diagrammatic view of a dispensing appliance, the cover not being illustrated.
Figure 2:
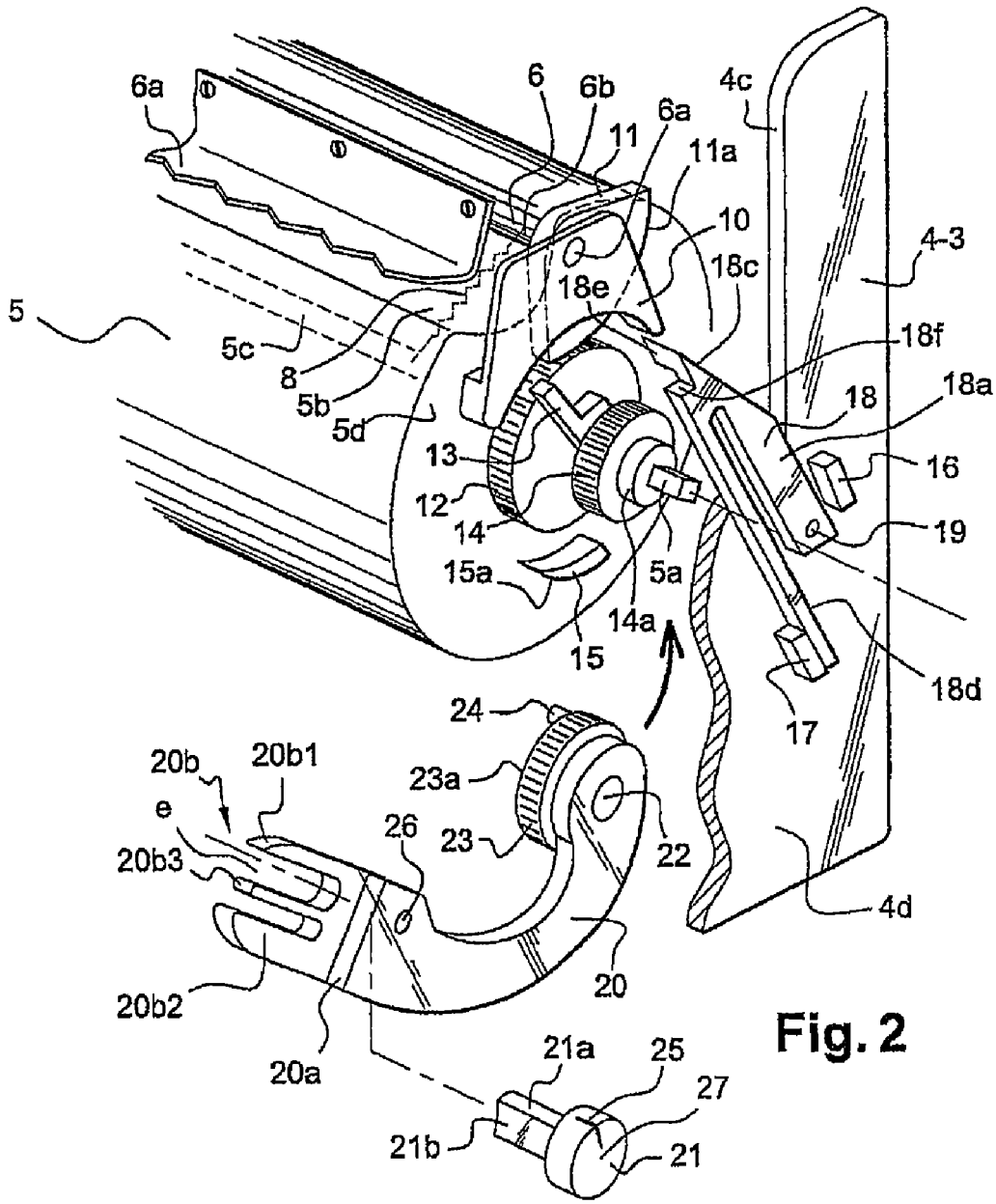
FIG. 2 is a partial perspective view of the device of the invention, before assembly and illustrating the essential components.
Figure 3:
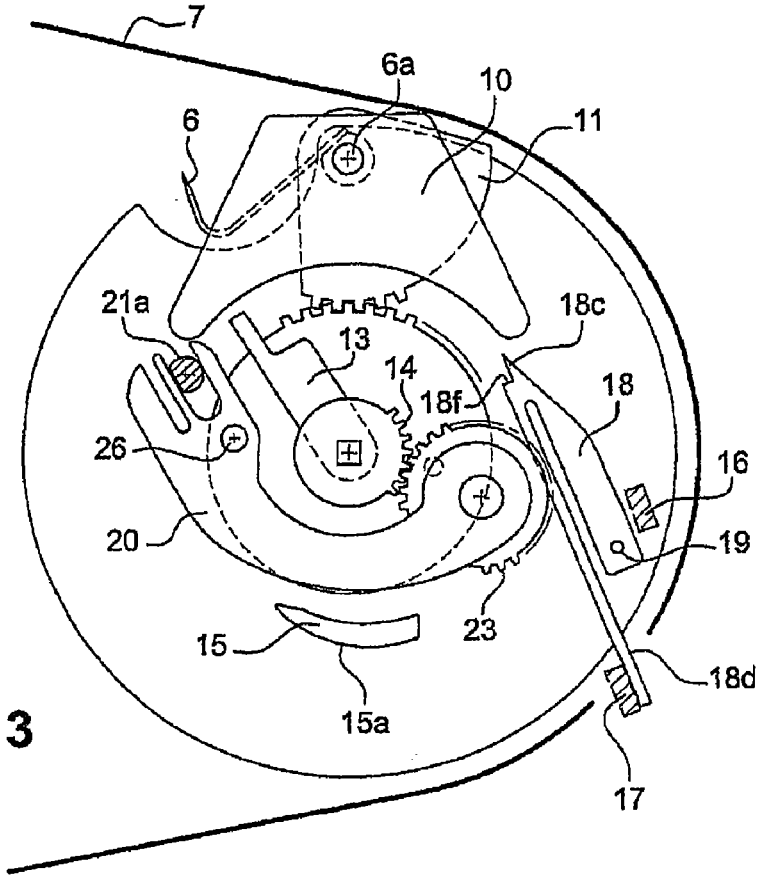
FIGS. 3, 4, 5 and 6 are diagrammatic views illustrating the cutting device, the format selector means not being shown, and operation taking place through the dispensing of a small-format material strip.
Figure 4:
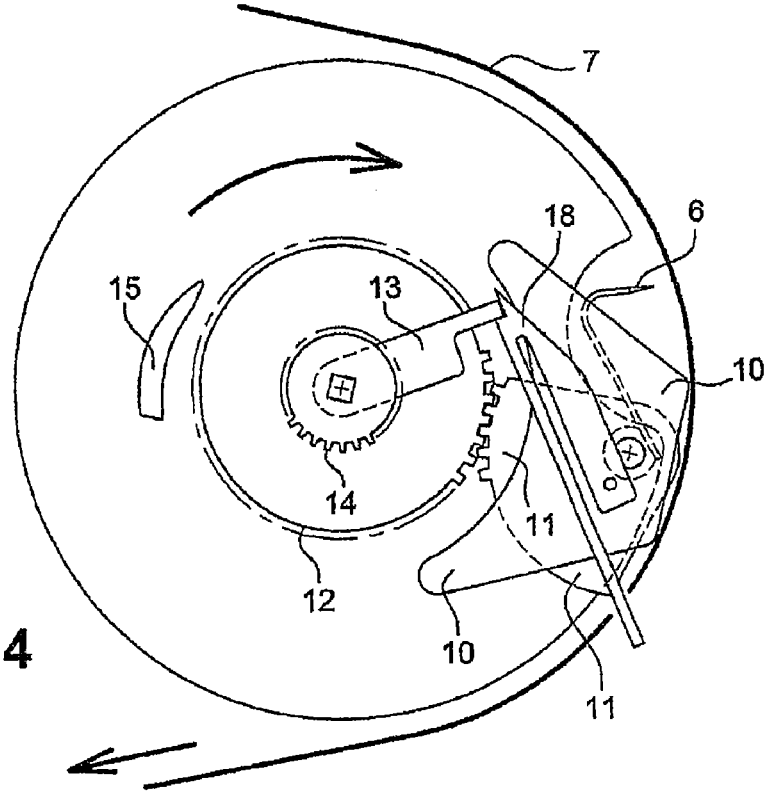
Figure 5:
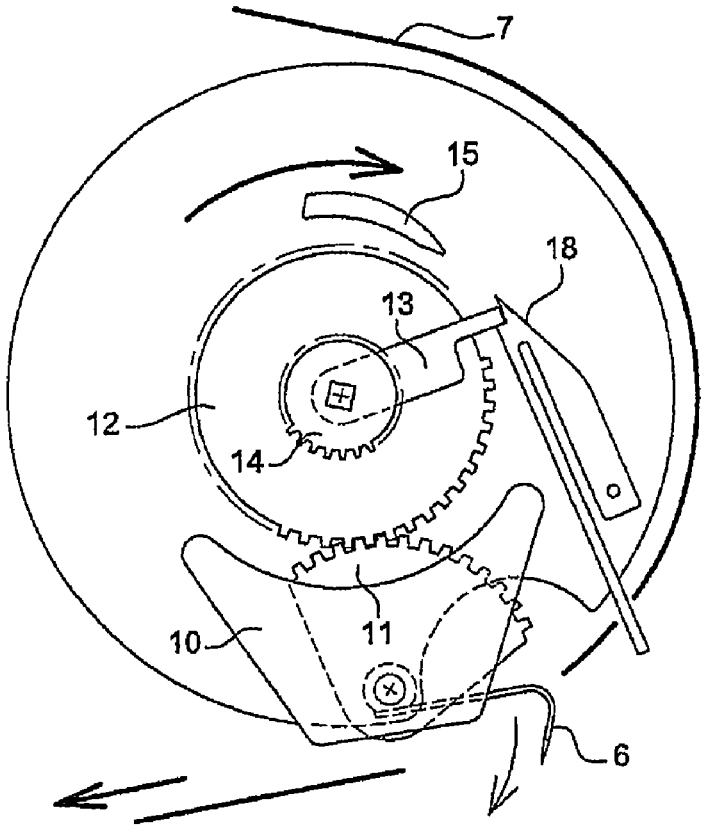
Figure 6:
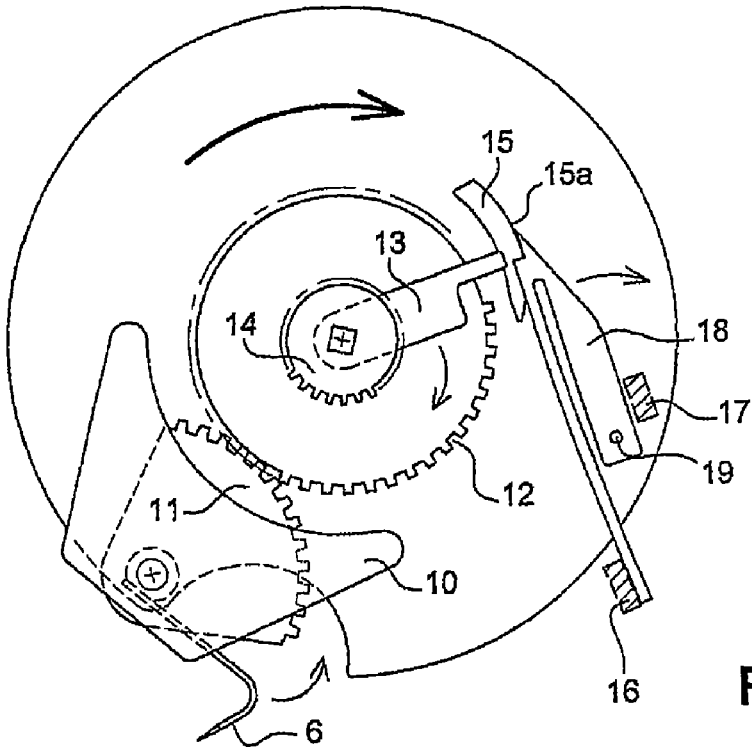
Figure 7:
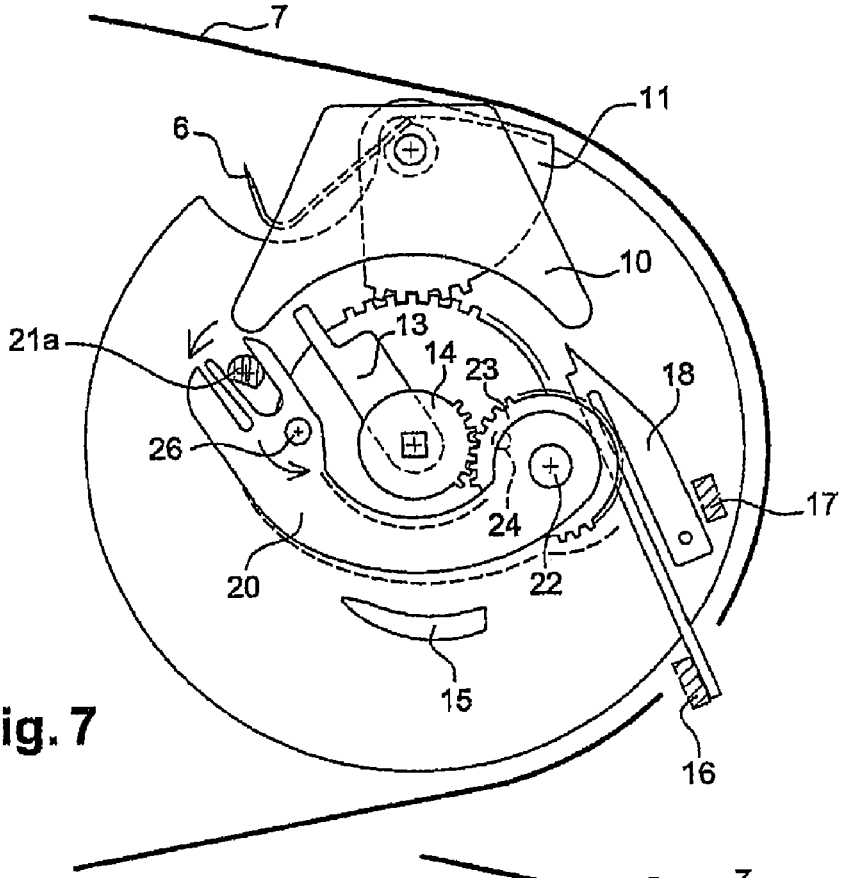
FIGS. 7 to 9 are diagrammatic views illustrating the cutting device, the selector means being shown by its shaft, and in terms of the dispensing of a large format.
Figure 8:
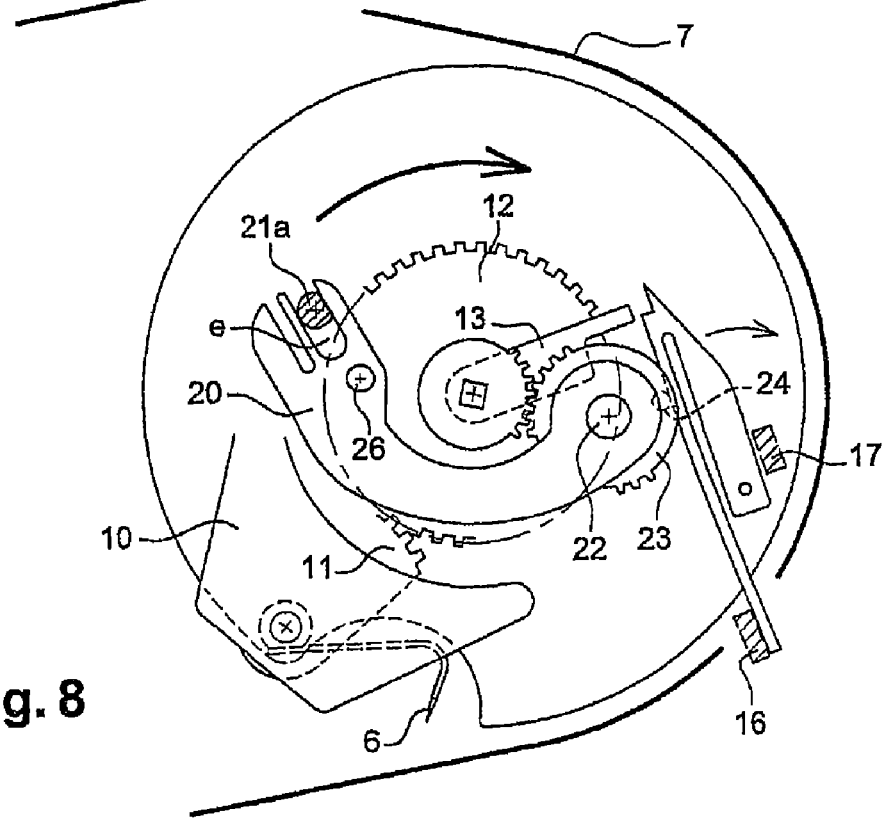
Figure 9:
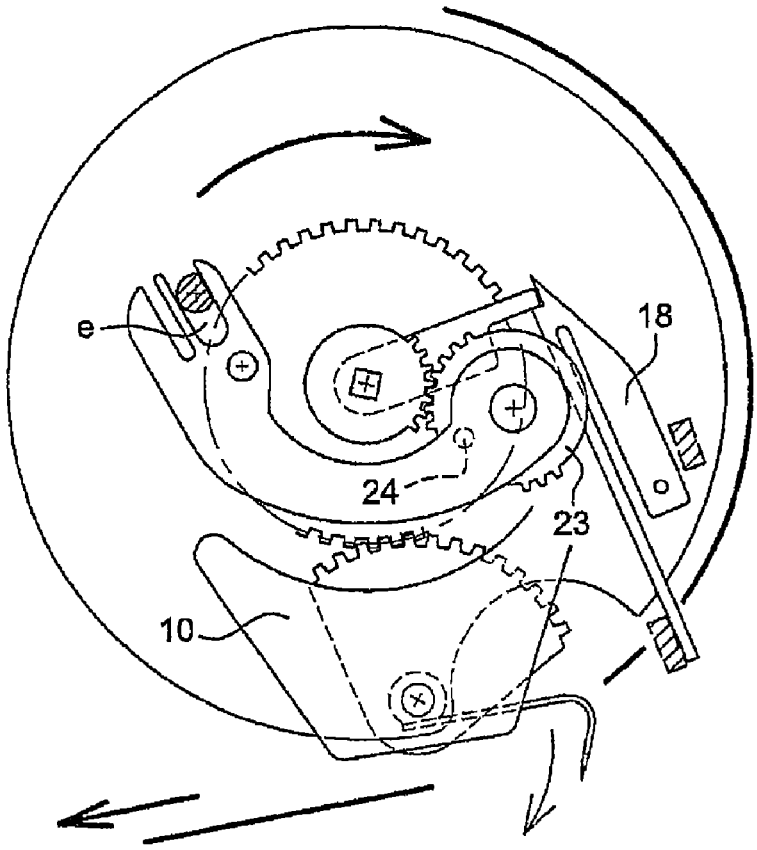
Figure 10:
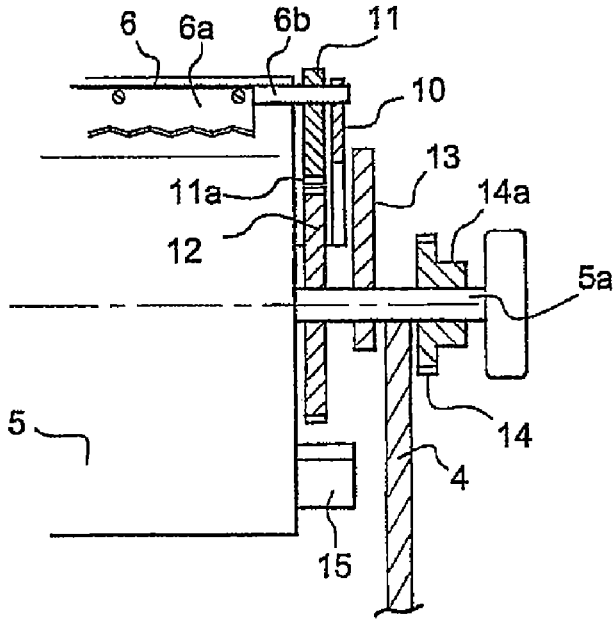
FIG. 10 is a partial diagrammatic view illustrating the drum and the various successive assembled components.
Figure 11:
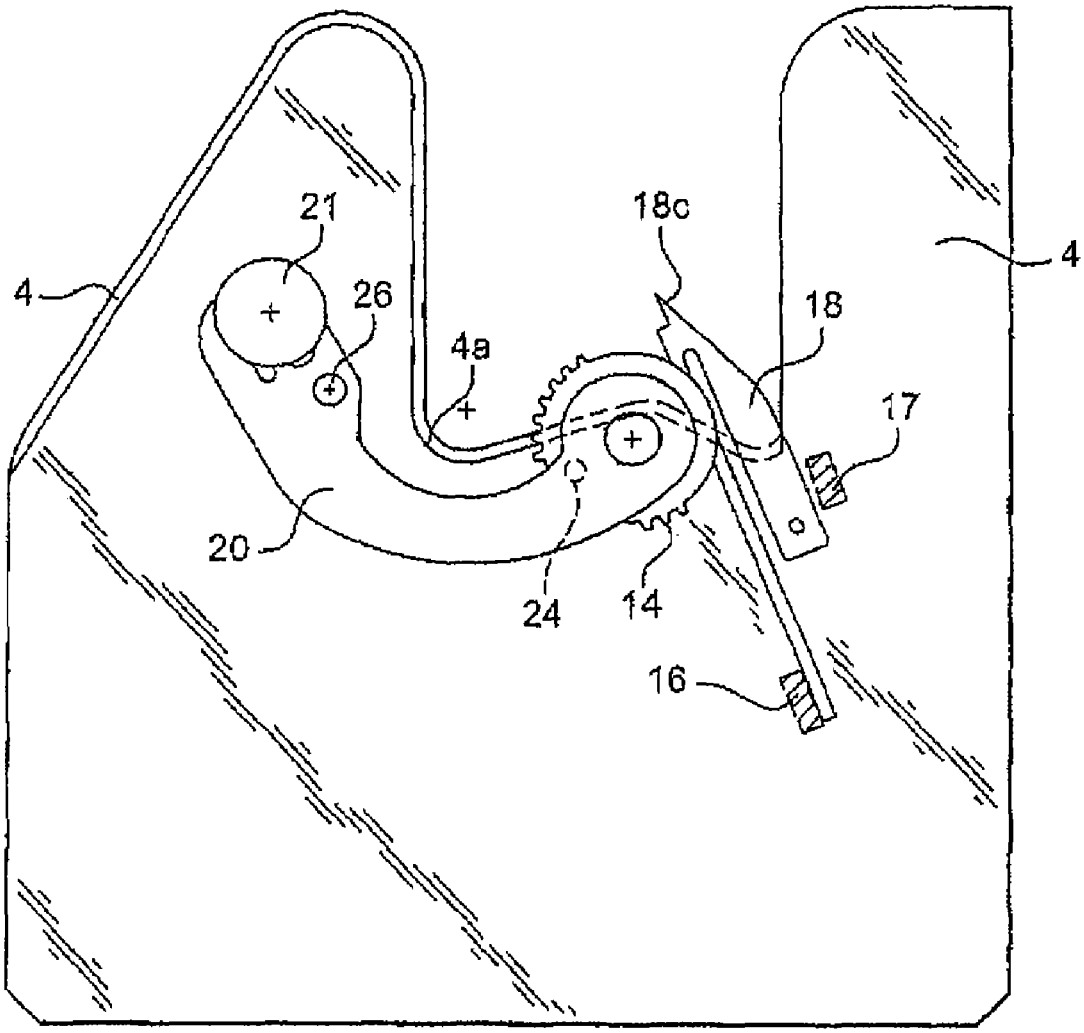
FIG. 11 is a partial view of the flange supporting the format selector means.

In order to put the subject of the invention into more concrete terms, it is now described in a non-limiting way illustrated in the figures of the drawings.

The dispensing appliance is designated as a whole dimensionally by (1) and comprises a housing (2) having lateral flanges (3) (4) supporting the drum (5), including a cutting device, on the one hand, and the material reel (7), on the other hand. In a known way, the drum, the end shafts (5*a*) of which are positioned in the flanges (3) (4), has a longitudinal indentation (5*b*) capable of receiving the blade carrier (6) supporting the blade (6*a*), this being in an articulated manner. A spring (8) ensures the elastic return of the blade carrier, the said spring being fastened at one end to the central hub (5*c*) of the drum and at the other end to the said blade carrier.

According to the invention, one of the transverse sides (5*d*) of the drum (5) has, in its prolongation, a supporting plate (10) obtained by being moulded together with the structure of the said drum and being offset with respect to the said lateral side (5*d*). The supporting plate has an orifice (10*a*) for fastening the end (6*b*) of the blade carrier (6). Mounted on the said end of the latter is a toothed quadrant (11) designed according to an angulation of approximately 70 to 80° and having a plurality of teeth (11*a*) at its peripheral end. These teeth are capable of cooperating with a gearwheel (12) mounted freely and underneath on the shaft (5*a*) of the drum, so as to allow the emergence of the cutting blade, as will be explained later. The said gearwheel (12) is secured to a hooked cam (13) which rotates with the said gearwheel during the rotary operation of the drum. Moreover, the end of the shaft (5*a*) of the drum receives a small-diameter gearwheel (14) prolonged by a fastening bearing surface (14*a*). In parallel, the flange (4) supporting the abovementioned guide shaft (5*a*) is itself arranged with an indentation (4*a*) for the positioning and bearing of the shaft of the drum. The drum (5) additionally possesses, on its outer lateral face (5*d*), a projecting shape (15) with a ramp profile (15*a*), this shape being secured or formed during moulding. The flange (4), in its upper part, receives, attached and in one piece, two fixed shapes forming stops (16) (17), between which is positioned a profiled body (18) which is fastened in its lower part by means of a connecting and pivoting shaft (19) arranged between the two abovementioned stops. This body is shaped so as to have an elastic deformation capability under the conditions which will be defined below. This body comprises an elongate central base (18*a*), the upper end (18*b*) of which has an appendage (18*c*) shaped in the form of an L or of a hook and forming a head, and which is positioned opposite the edge (4*c*) of the facing flange (4) and so as to project inwards slightly with respect to the said flange (4). Starting from its base (18*a*), the body (18) possesses a flexible tongue (18*d*), the rear end of which comes to bear on the stop (17). Thus, this body is capable of being subjected to tilting stress by virtue of its elastic deformation capability and with respect to its fastening and articulation point (19) on the flange (4). Moreover, the lower part (18*e*) of the head of this body forms a guiding and abutment zone by means of a setback (18*f*), the function of which will be specified later.

According to another arrangement of the invention, the lower part (4*d*) of the flange (4) is capable of receiving a bent lever (20) which is mounted pivotally with respect to an articulation shaft (26) secured to the facing flange (4). This lever (20) is shaped in a very special way on either side of its articulation shaft. At the front, it has a setback (20*a*) profiled in the form of an L, so as to define a trident shape (20*b*). The latter thus comprises two outer teeth (20*b*1) (20*b*2), between which is formed a flexible tongue (20*b*3). The space (e) formed between the tooth (20*c*1) and the flexible tongue (20*b*3) is capable of receiving a profiled shaft (21*a*) projecting from a format selector knob (21). This profiled part (21*a*) has a flat (21*b*), the function of which will be described later. The selector knob is fastened by means of screws (27) to the flange (4) from the reference part (25). At its opposite end, the bent lever (20) is capable of receiving, by means of a connecting shaft (22), a gearwheel (23) which will be capable of meshing with the underlying gearwheel (14) mounted on the shaft (5*a*) of the drum (5). The gearwheel (23), on its face (23*a*) opposite the wall of the flange, receives a projecting boss (24) forming a finger, the function of which will be described later.

The selector knob advantageously possesses a reference (25) making it possible to identify its position according to the two small-format and large-format dispensing modes.

Now that the structure of the invention has been described, it is appropriate to proceed with the description of the operation of the cutting device when the latter is subjected to stress in order to cut material strips in a first format, for example 20 to 25 cm, or in a larger format, double the preceding one, 40 to 50 cm. Reference is therefore made to the drawings in order to explain the two operating phases.

A) Dispensing and Cutting of a Material Strip According to the Small Format (20 to 25 cm)

In this situation, the selector knob (21) is in a situation between the tooth (20*b*1) and the flexible tongue (20*b*3) such that its flat part (21*b*) faces the wall of the tongue. In this situation, the said bent lever (20), in its lower part receiving the wheel (23), is remote from the abovementioned body (18) secured to the flange (4) and arranged in an adjacent plane. In this situation, the cutting operation takes place as follows.

In the initial phase, the drum (5), in the position of rest, causes the cutting blade to be retracted substantially within the drum. The toothed quadrant (11) meshes with the gearwheel (12), mounted on the shaft (5*a*) of the drum, near its lateral side associated with the hooked cam (13). In this situation, these teeth (11*a*) located at one end of the quadrant are in contact with the gearwheel (12). On the other side of the flange, the gearwheel (23) associated with the bent lever (20) meshes with the gearwheel (14) mounted on the shaft (5*a*) of the drum (5). The elastic-deflection body (18) is not subjected to stress. When the material strip is pulled by the operator, the drum is set in rotation rearwards and only the gearwheel (12) and the associated hooked cam (13) rotate. The toothed quadrant (11) does not for the moment undergo any movement about the facing gearwheel (12). The hooked cam (13) comes into abutment and contact against the head of the flexible body (20) and, in particular, its setback (18*f*), thus ensuring a locking in position. In this situation, under the effect of the pull on the material strip, the toothed quadrant (11) associated with the drum (5) is caused to rotate about the gearwheel (12) which is locked in position due to the connection of the hooked cam to the head of the abovementioned body. This brings about the emergence of the cutting blade from the drum. The continuous rotation of the drum causes the projecting shape (15), which is secured to its lateral side (5*c*), to come into contact, in turn, with the flexible head of the body (20) and, by passing underneath, to lift the said head by virtue of the elastic deformation and raising capability of the latter. This lifting takes place on account of the counterflexibility of the lower tongue of the said body. The lifting of the head frees the hooked cam (13) which can therefore tilt with the gearwheel (12) returning to the initial position due to the expansion effect of the spring (8) which returns the blade carrier. The lifting of the head of the body takes place when the cutting blade is in maximum emergence. At each revolution of the drum, there is a cutting of a material strip to the selected format.

B) Dispensing and Cutting of a Material Strip According to the Large Format (40 to 50 cm)

It is now appropriate to describe the format selection variant. In this implementation, it is appropriate to act on the selector knob (21) by rotating it half a revolution, so as to cancel the contact of the flat part (21*b*) of the shaft of the knob with the opposite faces of the teeth of the bent lever (20). Since the shaft of the selector knob has a larger diameter, this causes the intermediate flexible tongue (20*b*3) to move apart, the latter coming into contact with and pushing on the tooth (20*b*2) located immediately behind. This gives rise to a slight pivoting of the bent lever (20) with respect to its rotary shaft (26). Consequently, the rear part of the bent lever is raised slightly so as to approach the finger-forming projecting boss (24) of the gearwheel (23) associated with the rear part of the lever towards the lower base of the body.

Once the selector knob is put into position, it is appropriate to describe the operation of the device as a whole by therefore considering the dispensing of a material strip according to a double format. To achieve this function, it is necessary that the cutting blade takes action only alternately.

The procedure is therefore as follows. In the initial phase, the toothed quadrant is in engagement by means of its teeth (11*a*) with the gearwheel (12). The pulling of the material strip causes the rearward rotation of the drum and thereby the rotation of the gearwheel (12) and of the hooked cam (13) associated with the latter. The said hooked cam then comes into abutment against the head of the body (20), at the same time causing it to be locked in position with the associated wheel (12). Continuous rotation brings about the displacement of the toothed quadrant and of the blade carrier and therefore the emergence of the blade. At this moment, the finger-forming boss formed on the wheel (23) is opposite the lower face of the body (20). The continuous rotation of the drum causes the projecting shape (15) secured to the lateral side (5*d*) of the drum (5) to ensure the lifting of the head of the body and the freeing of the hooked cam (13). The renewed rotation of the drum this time causes the finger-forming boss associated with the wheel (23) to bring about the lifting of the head of the body (20), so as to escape and prevent any contact with the hooked cam which once again comes opposite this zone. Under these conditions, the hooked cam is not braked, nor is its associated gearwheel (12) therefore, and there is no action for the purpose of ensuring the emergence of the cutting blade. This makes it possible, when the finger-forming boss has passed its contact point with the body, subsequently to execute a second rotation of the drum, this time for the purpose of the emergence of the cutting blade. To be precise, the boss will no longer be in contact with the body, and the hooked cam will this time come into contact with the head of the body, at the same time giving rise to the pivoting of the toothed quadrant and therefore to the emergence of the cutting blade, and then the projecting shape will lift the said head of the body, at the same time freeing the hooked cam, and allow emergence. By virtue of this original arrangement, the dispensing of a double-format material strip is obtained.

The advantages emerge clearly from the description, and, in particular, the simplicity of the mechanism of the device and its immediate adaptability to the selected format by an operator are emphasized and recalled. The Applicant noted a high degree of operating smoothness of the cutting device. Thus, by means of a limited number of additional parts, this second format selection function can be ensured.

The invention claimed is:

1. Appliance for dispensing of wiping material, comprising a housing with lateral flanges, between which are arranged a drum receiving a blade carrier with a cutting blade, and a material reel, wherein one lateral side of the drum has a prolongation with an offset supporting plate possessing an orifice for fastening an end of the blade carrier, and a toothed quadrant is mounted on said end, with a toothed peripheral end, and the toothed quadrant cooperates with a gearwheel mounted freely on a shaft of the drum, said gearwheel being secured to a hooked cam, and the drum possesses, on an outer face of the lateral side, a projecting shape with a ramp profile, and a lateral facing flange of the housing receiving the shaft of the drum allows fastening of a profiled body arranged between two fixed stops, said body having an elastic pivoting capability and an end forming an appendage and head cooperating either with the hooked cam or with the projecting shape, according to operation and pulling of a strip of the material.

2. Appliance according to claim 1, wherein the toothed quadrant has an angulation of approximately 70 to 80°, and a plurality of teeth at a peripheral end.

3. Appliance according to claim 1, wherein an end of the shaft of the drum receives a small-diameter gearwheel with a fastening bearing surface.

4. Appliance according to claim 1, wherein the flange of the housing, in an upper part, receives two fixed shapes forming stops, between which is positioned the body which is fastened in its lower part by means of a connecting shaft between the stops and to the flange.

5. Appliance according to claim 4, wherein the body comprises an elongate central base, an upper end of the body has an appendage shaped in the form of an L or of a hook and forming a head, and the head is positioned opposite an edge of the facing flange of the housing so as to project inwards slightly with respect to said flange, and, starting from the base, the body possesses a flexible tongue, a rear end of the tongue comes to bear on one of the stops, and a lower part of the head of the body forms a guiding and abutment zone by means of a setback.

6. Appliance according to claim 5, wherein a lower part of the flange of the housing is adapted to receive a bent lever mounted pivotally with respect to an articulation shaft secured to the facing flange, and the lever is shaped on either side of an articulation shaft, at a front, with a setback profiled in a form of an L, so as to define a trident shape, and, at an opposite end, the bent lever has a connecting shaft for receiving another gearwheel to mesh with the underlying gearwheel mounted on the shaft of the drum, and the another gearwheel receives, on a face opposite a wall of the flange, a boss forming a projecting finger.

7. Appliance according to claim 6, wherein the trident shape comprises two outer teeth, between which a flexible tongue is formed, and a space formed between one tooth and the flexible tongue is adapted to receive a profiled shaft of a knob.

8. Appliance according to claim 7, wherein the knob provides a format selector function, and includes a profiled shaft that has a flat which, depending on knob position, does or does not move apart the flexible tongue with respect to the outer teeth and which causes tilting of said lever with respect to its fastening point, and the selector knob is fastened to the flange by a shaft, and comprises a reference.

9. Appliance according to claim 6, wherein the boss forming a projecting finger, arranged on the another gearwheel, ensures a function of spacing apart the body when the bent lever is tilted as a result of the positioning of the format selection knob in a double-format dispensing situation.

* * * * *